US006222459B1

(12) United States Patent
Ting

(10) Patent No.: US 6,222,459 B1
(45) Date of Patent: Apr. 24, 2001

(54) METHOD OF WORD SCREEN FORMATION BY LASER LIGHT PROJECTION AND THE STRUCTURE FOR THE SAME

(75) Inventor: Chih-Yu Ting, Taipei Hsien (TW)

(73) Assignee: Opcom, Inc., Sanchung (TW)

( * ) Notice: Subject to any disclaimer, the term of this patent is extended or adjusted under 35 U.S.C. 154(b) by 0 days.

(21) Appl. No.: 09/358,468

(22) Filed: Jul. 22, 1999

(51) Int. Cl.[7] ..... G08B 5/00; G09G 3/00

(52) U.S. Cl. ..... 340/815.4; 340/815.52; 340/815.53; 340/557; 345/31; 345/32

(58) Field of Search ..... 340/815.4, 815.52, 340/815.53, 557; 345/31, 32

(56) References Cited

U.S. PATENT DOCUMENTS 3,935,566 * 1/1976 Snopko ..... 345/32
4,084,339 * 4/1978 Peltier et al. ..... 345/32
4,470,044 * 9/1984 Bell ..... 345/32
5,294,940 * 3/1994 Wennagel et al. ..... 345/31
5,504,496 * 4/1996 Tanaka et al. ..... 345/32
5,734,154 * 3/1998 Jachimowicz et al. ..... 345/31

* cited by examiner

*Primary Examiner*—Donnie L. Crosland
(74) *Attorney, Agent, or Firm*—Rosenberg, Klein & Lee

(57) ABSTRACT

The present invention relates to a method of word screen formation by laser light projection and the structure of word formation by laser light projection, and in particular, relates to a plurality of laser production devices arranged in a single column and by rapid reciprocating action of the devices to project multiple columns of light track and form word arrays.

5 Claims, 8 Drawing Sheets

METHOD OF WORD SCREEN FORMATION BY LASER LIGHT PROJECTION AND THE STRUCTURE FOR THE SAME

BACKGROUND OF THE INVENTION (a) Field of the Invention

The present invention relates to a method and structure of word formation by laser light projection, and in particular, relates to a plurality of laser production devices arranged in a single column and by rapid reciprocating action of the devices to project multiple columns of light track and form word arrays.

(b) Description of the Prior Art

Words or character screens are widely used in advertisement or all kinds of promotional activities. As shown in FIG. 1, the word which is to be illustrated is first sectioned into a plurality of columns of word tracks formed by a plurality of dots, and then combine the circled dots (denoted by the black dot) of each column, a complete word configuration is formed. The matrix reference points are marked at the side of the array area which formed the word track, to attain the effect of comparing the coordination position.

In conventional lighted-configured word screen method, on the illustrating wall, each dot corresponding to the array word area, is mounted with LEDs. Every position of the matrix coordination $X_{ij}$ $X_{11}$, $X_{12}$, $X_{nm}$ is mounted with LEDs. If the character is to be shown, the corresponding LEDs of the entire column are lighted at the same time (for instance, $X_{13}$, $X_{14}$, $X_{22}$, $X_{n-1}$, $X_{nm}$ of the black dots position are lighted). That is the arrangement of the word s is completed if the LEDs are lighted. However, this conventional structure and method of light illustration have the following drawbacks:

(1) Since every dot of the corresponding matrix word area of the illustration wall has to be mounted with a LED. Therefore the number of LEDs used is great. The bigger the screen, the more the LEDs are required, and the cost for the LEDs is high. Besides, after the LEDs have been embedded, the size of the screen is fixed and it cannot be reduced (2) The LEDs mounted wall does not allow the structure to shift from one place to another, and the LEDs cannot be mounted to all kind of wall.

SUMMARY OF THE INVENTION

Therefore, it is an object of the present invention to provide a method and structure of word screen formation by laser light projection, wherein a plurality of laser production devices, arranged in a single column, and by rapid reciprocating action of the devices to project multiple columns of light track and form word array. The structure of the present invention allows the distance of projection be adjusted and thus the size of the word can also be adjusted.

Another object of the present invention is to provide a method and structure of word screen formation by laser light projection, wherein the structure can be conveniently carried, and can be used on surface with slight reflection light to reflect bright word. Thus, the structure of the present invention can be used on a number of wall surface.

BRIEF DESCRIPTION OF THE DRAWINGS

For a fuller understanding of the nature of the invention, reference should be had to the following detailed description taken in conjunction with the accompanying drawings, in which.

DETAILED DESCRIPTION OF THE PRESENT INVENTION

Figure 1:
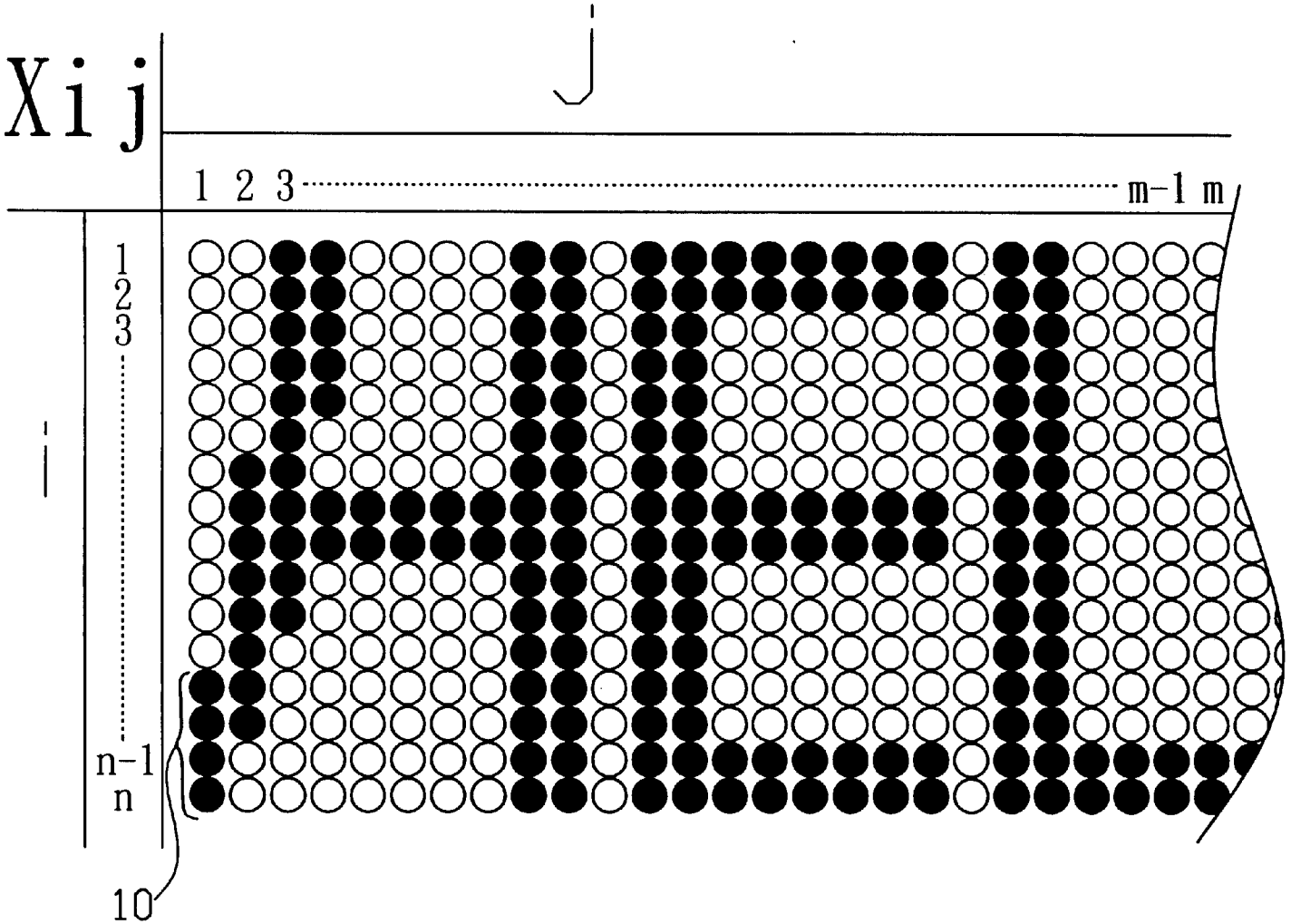
FIG. 1 is a screen illustrating the formation of word.
Figure 2:
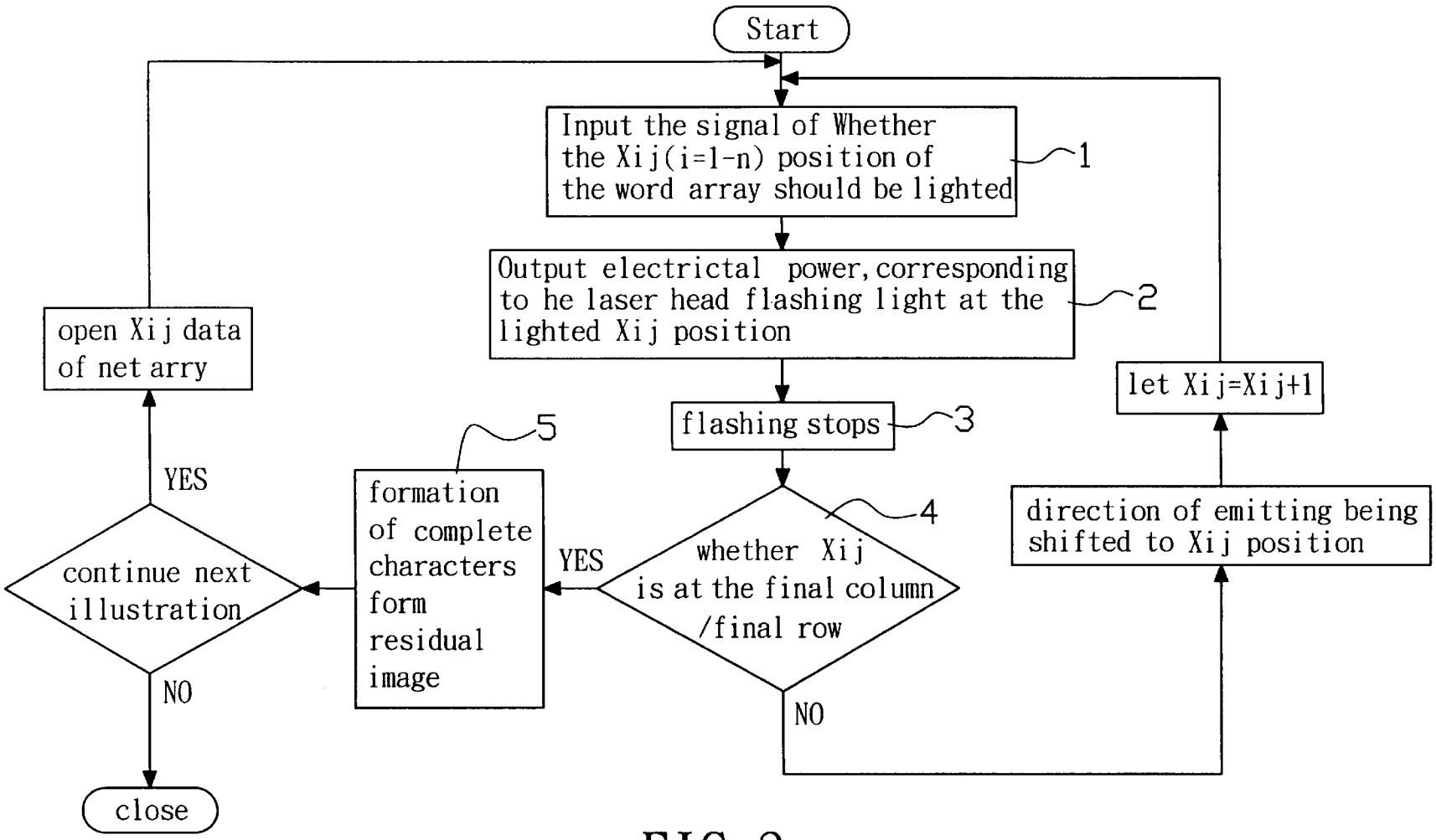
FIG. 2 is a flowchart illustrating the step of word screen formation by laser light projection in accordance with the present invention.

FIG. 1 shows word screen which can be formed conventionally by the use of LEDs. In accordance with the present invention, the word screen of FIG. 1 can be obtained in accordance with the steps depicted in FIG. 2. The present method of word screen formation by laser light projection comprises the steps of a) inputting sectioned data of the array characters;

b) converting the sectioned data, column by column (from j=1 to j=2, then form j=2 to j=3, j=3 to j=4) into flashing signal of a laser production device within the single column of a plurality of laser production devices (similar to the description of block 1 of FIG. 2);

c) within vision transient time period, emitting flashing block (for example j=1, from xn−3, 1, xn−2, 1, xn−1, xn, 1, four-corners flash to form the flashing block 10. This step is the contents of block 2 to block 3 of FIG. 3) which is corresponding to the column of the word track, column by column, (from j=1 to j=2, j=2 to j=3, j=3 to j=4) such that within the vision transient retaining time period, the laser production device moves to the final column and the residual image forms a complete word (refer to block 4 to block 5, although the word track of FIG. 2 lighted in sequence, the 1/16 sec human eye vision transient time allows us to see the complete lighted word.

Figure 3:
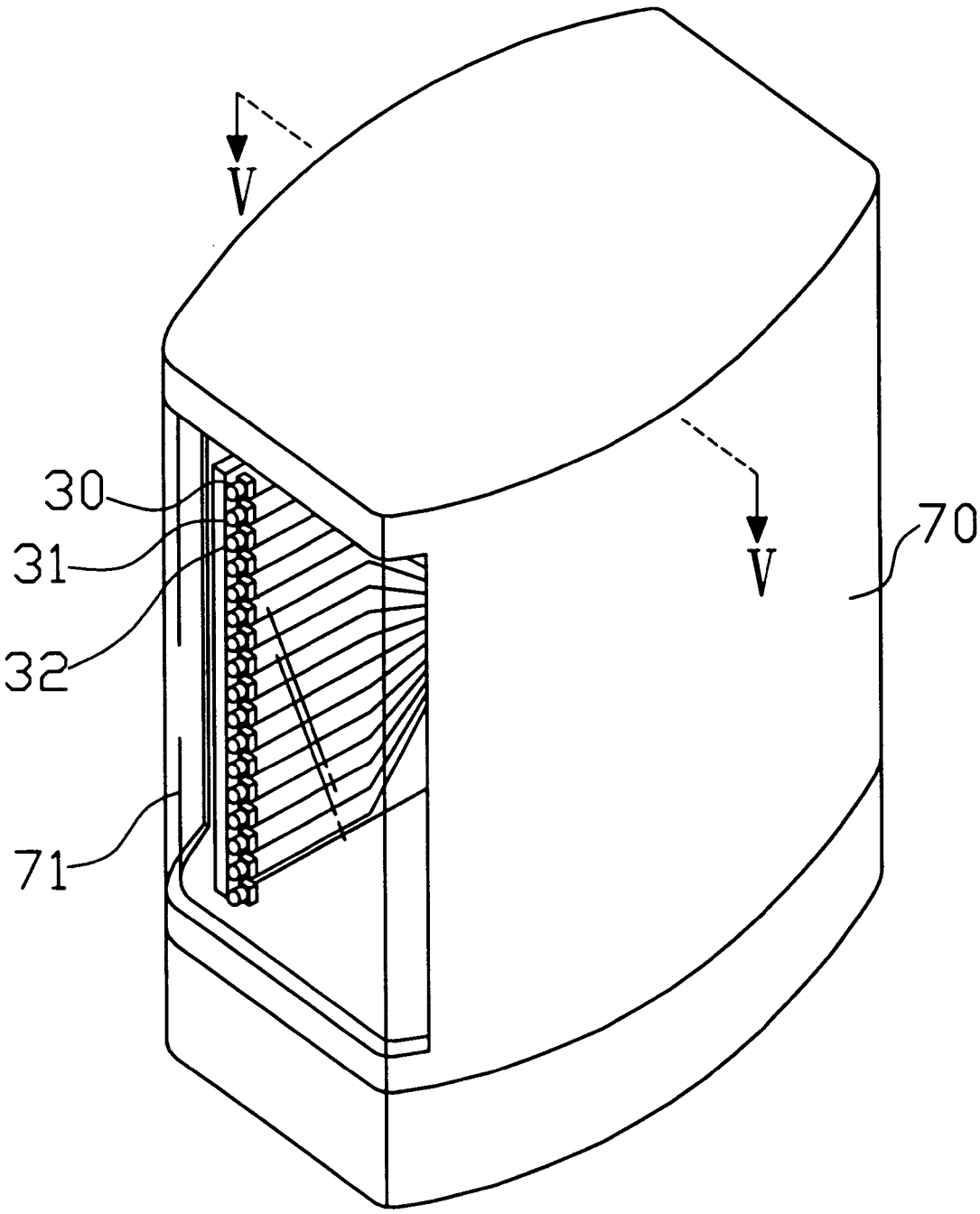
FIG. 3 is a perspective view of the structure for word screen formation by laser light projection in accordance with the present invention.
Figure 4:
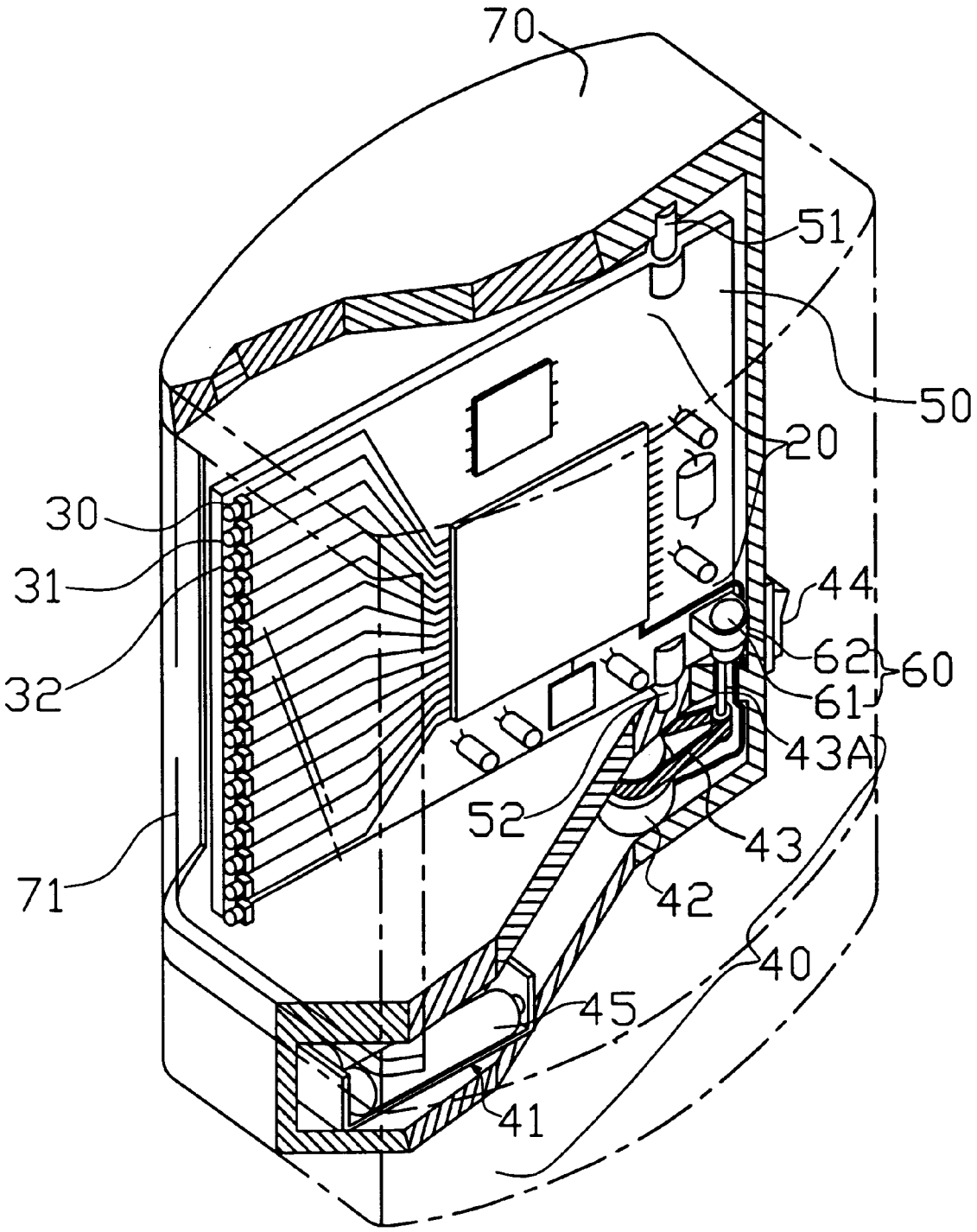
FIG. 4 is a sectional view of FIG. 3 in accordance with the present invention.

The structure implemented by the present method is shown in FIGS. 3 and 4. As shown in the drawings, the structure comprises a laser supply circuit 20, a plurality of laser production devices 30, 31, 32, a power source 40, a board body 50, a reciprocating mechanism 60 and a housing 70 containing all the above elements. In accordance with the present invention, the two lateral edges of the board body 50 are in engagement with the shafts 51, 52 which are provided to the inner wall of the lateral edge of the housing 70, and the board edge of the board body 50 facing the housing window 71 is mounted with a plurality of laser production devices 30, 31, 32 arranged in a single column, and on the board body 50, the laser supply circuit 20 is arranged thereon, and the reciprocating mechanism 60 driven by the power source 40 is connected to the board body 50 at an appropriate position. The power source 40 is normally connected to an electrical source 41 connected in series with a switch 44, and then is connected to a motor 42 linked to a speed-adjusting element 43 (as shown in the Figure, the speed-adjusting element 43 is a set of belted wheel and the output rotation of the motor 42 is adjusted to 1/16 second per revolution), and the output shaft 43A of the speed-adjusting element 43 is connected in series to the reciprocating mechanism 60. The reciprocating mechanism 60 (shown in the Figure) includes an eccentric wheel 61 and a wheel ring 62 at the outside of the wheel 61. The wheel ring 62 is secured to one end (at an appropriate position) of the board body 50, and the wheel centre of the eccentric wheel 61 is fixed to the shaft centre of the output shaft 43A. The electrical source 41 which provides the entire power supply is a series of batteries 45 or is linked externally to power lines.

Figure 5:
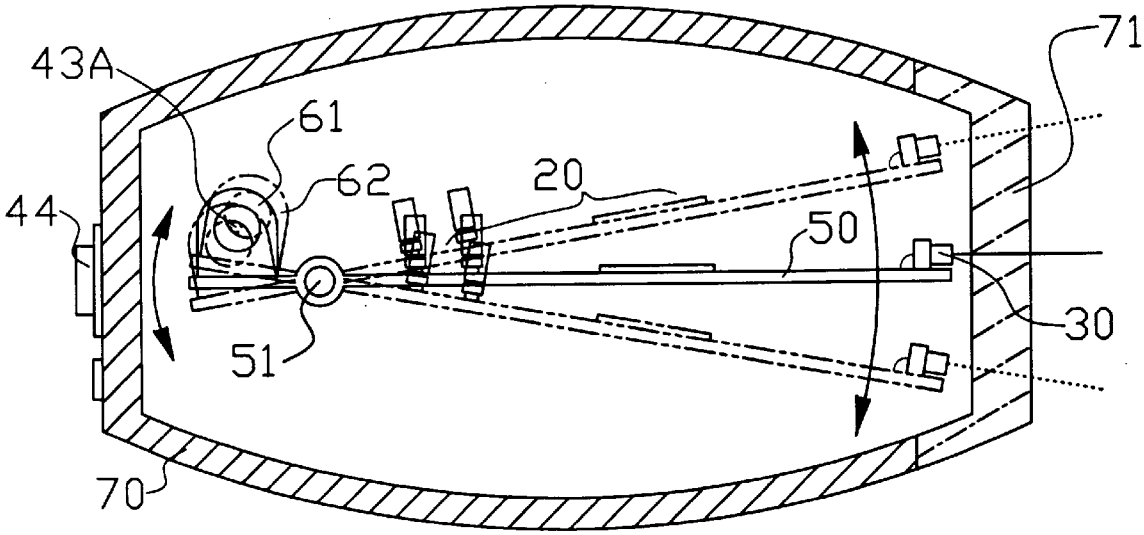
FIG. 5 is a sectional view along line V—V of FIG. 3 in accordance with the present invention.
Figure 6:
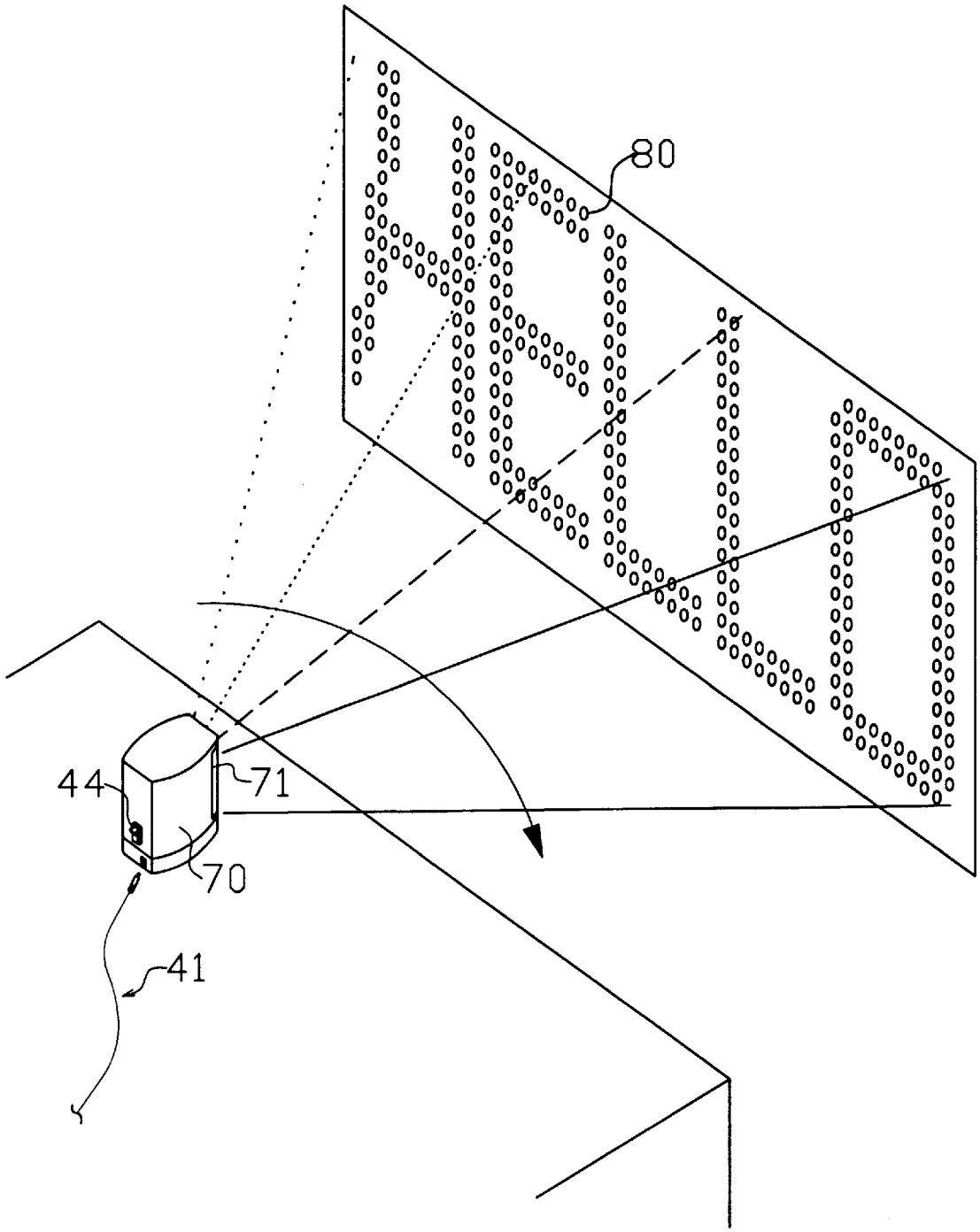
FIG. 6 is a schematic view illustrating the operation of the word screen formation by laser light projection in accordance with the present invention.

As shown in FIG. 5, when the output shaft 43A is rotated, it drives the eccentric wheel 61 to rotate, and the board body 50 rotates with the shaft 51 as the rotating centre, to produce a reciprocating swinging action. During the swinging action, the laser light emitted by the laser production device 30 (i.e. within the human eyes vision transient time), scans every column, and the laser supply circuit 20 in sequence provides every column of laser production device 30 the flashing signal, as shown in FIG. 6. As shown in FIG. 6, when the switch 44 is ON, a plurality of emitted laser beams can be directed to the remote wall and project complete characters in lighted word screen 80, and the distance of projection can be changed in accordance with the enlargement or reduction of the lighted word screen. In application, the structure is supported at a higher level to proceed with the projection, and it can also be placed indoor to provide illustration by projection.

Figure 7:
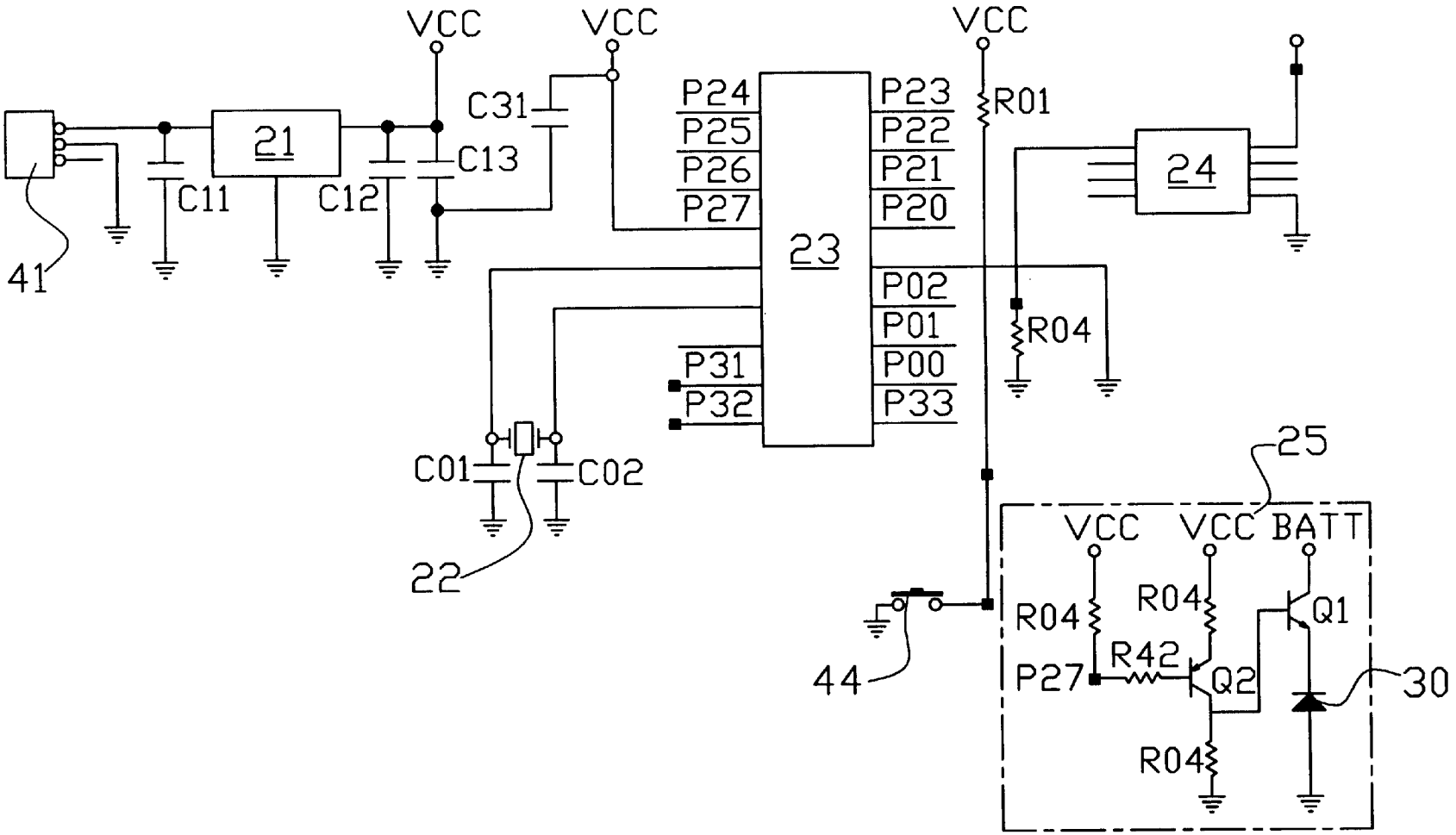
FIG. 7 is the laser supply circuit of a preferred embodiment in accordance with the present invention.

As shown in FIG. 7, the laser supply circuit 20 comprises a rectifier 21, an oscillator 22, a microprocessor 23, a memory 24, and a plurality of capacitors $C_1$, a plurality of resistor R, and a plurality of transistor $Q_1$ being connected to each other. In accordance with the present invention, the input terminal of the rectifier 21 is connected to the power source 41, and the output terminal of the rectifier 21 is connected to the input terminal of the power source of the microprocessor 23, and the signal input terminal of the memory 24 and the switch 44 are connected to the signal input terminal of the microprocessor 23.

The frequency input and output terminal of the microprocessor 23 are connected to the oscillator 22 and each of the output terminal P00, P01, of the microprocessor 23 is individually connected to a sub-circuit 25 (within a frame). The sub-circuit 25 comprises a transistor $Q_1$ having an emitting terminal connected in series to the ground of a laser production device 31 at a corresponding position, and the base terminal of the transistor $Q_1$ being connected to a collective terminal of another transistor $Q_2$, and the emitting terminal, the collective terminal and the base terminal of the transistor $Q_2$ being respectively connected to resistors $R_{43}$, $R_{44}$, $R_{42}$, after the base terminal being connected in series with the resistor $R_{42}$, then connect to a resistor $R_{41}$ and then to any output terminal P00, P01, and thus the entire circuit being provided with resistors and capacitors $C_1$ at appropriate positions.

In accordance with the present invention, after the switch 44 of the microprocessor 23 is ON, the signal of each row of characters of the memory array within the memory 24 can be obtained. The microprocessor 23 then processes the signal, and in combination with frequency demodulation of the oscillator 22, outputs a power to a certain processed output terminal (P00 or P01) of certain corresponding row of signals, and emits laser light of corresponding word tracks.

Figure 8:
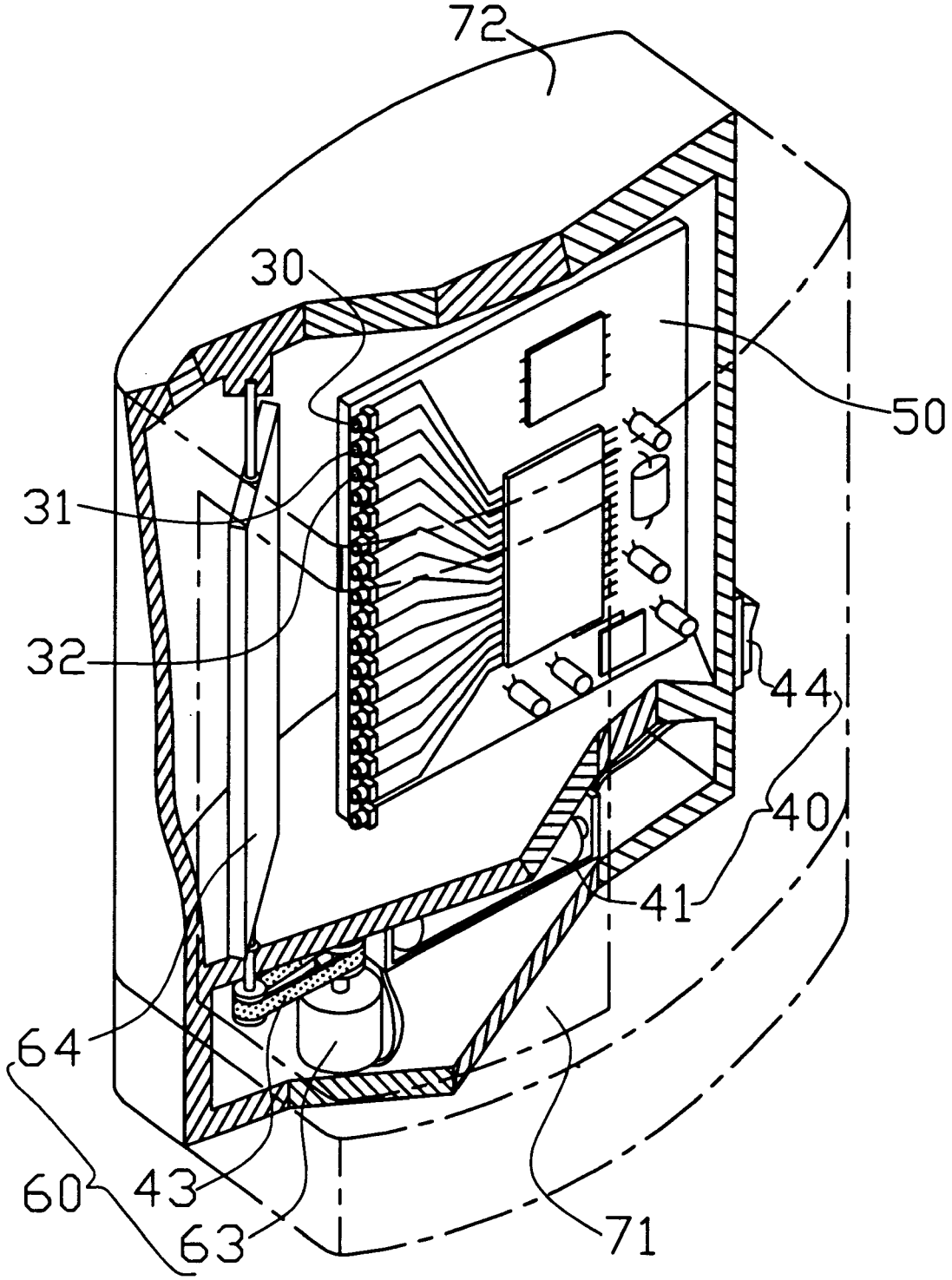
FIG. 8 is a partial perspective view illustrating the structure of word screen formation by laser light projection in accordance with the present invention.

In another preferred embodiment of the present invention, and as shown in FIG. 8, the lateral edge of the board body 50 and the inner wall of the two lateral edges of the housing 72 are in engagement with each other, and adjacent to the board body 50, is a plurality of laser production devices 30, 31, 32 are mounted. At the laser port, the reciprocating mechanism 60 driven by the power source 40 is provided. The power source 40 is an electrical source 41 connected in series to a switch 44, and the reciprocating mechanism 60 is a reciprocating swinging type electric motor 63 connected to a speed-adjusting element 43. The centre of the output shaft of the speed-adjusting element 43 is provided in vertical with a reflection mirror 64. The electric motor 63 is electrically connected to the power source 40 and the reflection surface of the reflection mirror 64 faces the laser port of the laser production devices 30, 31, 32, such that the laser light emitted from the laser port is directed to the reflective mirror 64 while the mirror 64 is swinging, and the light is reflected through the housing window 71 to the column position, where the projection face corresponding to the lighted word screen, and forms lighted word tracks.

In view of the above, the method and structure of word formation by laser light projection project a multiple column of light tracks to form character array by a single column, multiple laser production device by means of rapid reciprocating action. In accordance with the present invention, the structure can be used in various type of wall screen and illustration.

While the invention has been described by way of example and it is to be understood that the invention is not limited to the disclosed preferred embodiment. To the contrary, it is intended to cover various modifications and similar arrangements as would be apparent to those skilled in the art. Therefore, the scope of the appended claims, which define the invention, should be accorded the broadest interpretation as to encompass all such modifications and similar structures.

What is claimed is:

1. A method of word screen formation by laser light projection comprising the steps of:

a) inputting sectioned data of an array of characters;

b) providing a laser projection device having a plurality of laser production devices arranged in a single column on a board body and a reciprocating mechanism for pivotally displacing said board body, said board body having a laser supply circuit mounted thereon and coupled to the plurality of laser production devices;

c) converting the sectioned data into flashing signals for each of a plurality of columns;

d) supplying said flashing signals to said laser production device for a corresponding column;

e) emitting a flashing block from at least a portion of said plurality of laser production devices, said flashing block corresponding to a display column portion of said array of characters; and, f) causing said reciprocating mechanism to pivot said board body sufficient to emit a flashing block to an adjacent display column; and g) repeating steps d–f until a respective flashing block of a last of said plurality of columns is emitted for projecting a complete laser light array of characters.

2. The structure for word screen formation by laser light projection comprising a laser supply circuit, a plurality of laser production devices, a power source, a board body, a reciprocating mechanism and housing, wherein the two lateral edges of the board body are in engagement with the two lateral edges of the housings and the board end of the board body facing the housing window, is provided with a plurality of laser production devices arranged in a single column, and the laser supply circuit is provided on the board body, and adjacent to the board body, the reciprocating mechanism operated by the power source is provided, thereby, the action of the reciprocating mechanism causes the laser light to be emitted out, eccentrically column by column, to form laser word screen.

3. The structure for word screen formation by laser light projection as set forth in claim 2, wherein the power source consists a power source connected in series to a switch which in turn connected to a motor having a speed adjusting element, the output shaft of the speed adjusting element is connected in series with the reciprocating mechanism, and the reciprocating mechanism consists of an eccentric wheel and a wheel ring which surrounds the eccentric wheel, the wheel centre of the eccentric wheel being connected to the shaft centre of the output shaft, and the power source being a series of batteries or from an external power supply.

4. The structure as set forth in claim 3, wherein the laser supplying circuit comprises a rectifier, an oscillator, a microprocessor, a memory and a plurality of capacitors, resistors, and transistors connected together, the input terminal of the rectifier is connected to the power source and the output terminal of the rectifier is connected to the input terminal of the power source of the microprocessor, the signal output terminal, and the switch are connected to the signal input terminal of the microprocessor, and the frequency input and output terminal of the microprocessor are connected to the oscillator, and each output terminal of the microprocessor is connected to the sub-circuit, the sub-circuit consists of an emitting terminal of the transistor being connected in series to the ground of the laser production device at the corresponding position thereof, and the base terminal of the transistor is connected to the collective terminal of other transistor, and the emitting terminal, the collective terminal and the base terminal of the transistor are connected to the resistor, after the base terminal of another transistor is connected in series with the resistor, a resistor and any output terminal are then connected, a plurality of resistors and capacitors are then mounted to the entire circuit at an appropriate position.

5. The structure as set forth in claim 2, wherein the power source is an electrical source connected to a switch, and the reciprocating mechanism is a reciprocating swinging motor connected to a speed-adjusting element, and the output shaft center of the speed-adjusting element vertically connected a reflection mirror, and the reciprocating swinging motor is connected to the power source, and the reflective face of the reflection mirror is facing the laser port of the laser production device such that the laser light from the laser port is emitted to the reflection mirror and produce a light reflection through the housing window to the corresponding column position of the lighted word screen and produce lighted characters.

* * * * *